United States Patent [19]

Brennan

[11] Patent Number: 4,997,003

[45] Date of Patent: Mar. 5, 1991

[54] LIQUID WASTE EVACUATION AND TRANSFER SYSTEM

[76] Inventor: Daniel F. Brennan, 705 Franklin, River Forest, Ill. 60305

[21] Appl. No.: 464,443

[22] Filed: Jan. 12, 1990

[51] Int. Cl.[5] ..... F04F 10/00

[52] U.S. Cl. ..... 137/147; 137/256; 137/360; 137/571; 137/590; 137/592; 184/1.5

[58] Field of Search ..... 137/142, 147, 148, 256, 137/360, 571, 590, 592; 184/1.5

[56] References Cited

U.S. PATENT DOCUMENTS

| | | | |
|---|---|---|---|
| 412,191 | 10/1889 | Kruse | 137/147 X |
| 608,960 | 8/1898 | Foulois | 137/147 |
| 1,651,616 | 12/1927 | Morrison | 184/1.5 |
| 1,963,519 | 6/1934 | Astle | 137/256 |
| 1,994,844 | 3/1935 | Winger et al. | 184/1.5 |
| 2,055,954 | 9/1936 | Tokheim | 137/148 X |
| 2,263,300 | 11/1941 | Haverky | 137/147 |
| 2,531,765 | 11/1950 | Burress | 184/1.5 |
| 3,384,132 | 5/1968 | Lisciani | 137/147 X |
| 4,274,645 | 6/1981 | Ferguson et al. | 184/1.5 X |
| 4,420,023 | 12/1983 | Cislak | 184/1.5 X |

*Primary Examiner*—John Rivell

*Attorney, Agent, or Firm*—Laff, Whitesel, Conte & Saret

[57] ABSTRACT

A method and apparatus for evacuating and transferring liquid waste comprising a pump assembly that is connected to a holding tank and to a liquid container; the pump assembly being mounted on a wall and elevated above the holding tank; the pump assembly including a flexible hose detachably mounted on one end to said pump assembly and which is adapted to be connected at a second end to an aperture in the container, the aperture in the container being connected to a suction mechanism extending to the bottom of the container to permit the pump assembly to drain substantially all of the liquid waste from the liquid container and into the holding tank.

17 Claims, 3 Drawing Sheets

LIQUID WASTE EVACUATION AND TRANSFER SYSTEM

FIELD OF THE INVENTION

This invention relates to a liquid waste evacuation system. More particularly, this invention relates to a method and apparatus for evacuating and transferring liquid waste from any standard waste oil drain assembly or container to an EPA and OSHA approved holding tank.

BACKGROUND OF THE INVENTION

In automotive garages, waste oil is routinely removed from automobile crankcases and transferred to a waste oil drain assembly which normally includes a funnel to catch the oil connected to a drum. After the drum is filled, the oil or other liquid contained in the drum must eventually be transferred to another container. Thus, a variety of fluid pumps or devices having transfer means for fluids are known. These pumps or devices include pumping systems that have a variety of different operating mechanisms and connecting pieces that may be used to transfer fluid, such as the hazardous waste materials accumulated in automotive garages, from one container to another. For example, Wemple U.S. Pat. No. 1,851,338 and Hill U.S. Pat. No. 4,004,862 illustrate devices that transfer fluid from a large drum to another container by use of a pump. However, these devices each require contact with the liquid during its removal and transfer from one container to the other.

Other fluid transfer apparatus' include devices that require dismantling of the drum prior to fluid transfer or that further involve numerous component parts that elevate the manufacturing cost due to their relatively complex construction. However, along with these structural shortcomings, there are additional problems associated with their use, including a time-consuming and difficult assembly and operating process, all at elevated operational expense. Moreover, the combination of environmental concerns and the risks involved in handling certain fluids, such as hazardous and flammable materials, has induced the Environmental Protection Agency and the Occupational Safety Health Administration to create and enact stringent regulations that control the handling and disposal of liquid wastes, including those wastes found in automotive garages.

Accordingly, an object of the present invention is to provide a method and apparatus for evacuating and transferring liquid waste from drums or other containers to EPA and OSHA approved holding tanks.

Another object of the present invention is to provide a method and apparatus for evacuating and transferring liquid waste that includes an apparatus having a pump assembly that is accessibly mounted to the wall of a garage or other structure.

Another object of the present invention is to provide a method and apparatus for evacuating and transferring liquid waste that includes a pump assembly that may be mounted to the interior of any automotive garage or other structure and which may be attached to any standard holding tank.

A further object of the present invention is to provide a method and apparatus for evacuating and transferring liquid waste including a wall-mounted pump assembly elevated above a holding tank so that the liquid moves by gravity to the holding tank and minimal effort is required to transfer the liquid.

A further object of the present invention is to provide a method and apparatus for evacuating and transferring liquid waste in which there is no contact with the liquid being transferred by the operator of the apparatus.

A further object of the present invention is to provide a method and apparatus for evacuating and transferring liquid waste in which the risk of a fire involving a flammable liquid is minimal.

A further object of the present invention is to provide a method and apparatus for evacuating and transferring liquid waste from a drum wherein the liquid may be transferred to the holding tank without removal of the drum lid.

A further object of the present invention is to provide a method and apparatus for evacuating and transferring liquid waste wherein the apparatus has space-saving capabilities in that the pump assembly is wall mounted and is attached to a holding tank that is preferably located outside of the building housing the pump assembly.

A further object of the present invention is to provide a method and apparatus for evacuating and transferring liquid waste that provides a fast and inexpensive method of liquid transfer from one container to another.

SUMMARY OF THE INVENTION

The present invention, in the preferred embodiment, comprise a method and apparatus that accomplishes the foregoing objects by providing an apparatus that removes liquids from containers, such as 16-gallon waste oil drums found in automotive garages, and transfers same to an EPA and OSHA approved holding tank. The apparatus comprises a pump assembly which is mounted to the garage wall. The pump assembly extends through the garage wall and is attached to a holding tank which is located on the other side of the garage wall. The pump assembly is elevated above the holding tank to provide a partial gravity feed from the pump to the holding tank.

It is precisely this pump assembly that enables the apparatus to be installed in any automotive garage and on any existing oil drum or container. Furthermore, it is precisely this pump assembly that complies with recent EPA and OSHA safety standards regarding holding tanks which are above ground. Moreover, this pump assembly eliminates the need for removal of the drum lid and provides for a fast, inexpensive method of liquid removal from the drum.

Thus, the inventive apparatus is inexpensive to manufacture, yet is more sturdy and durable than the previously described fluid transfer systems of the prior art. Moreover, the inventive apparatus is compatible with any size waste oil drain assembly or liquid waste drum and may be installed in any automotive garage. The inventive apparatus also is completely safe to operate in that the liquid being transferred does not come into contact with the operator.

The above, as well as other object and advantages of the invention, will become apparent from the following detailed description of the preferred embodiments, reference being made to the accompanying drawings.

DETAILED DESCRIPTION OF THE INVENTION

Figure 1:
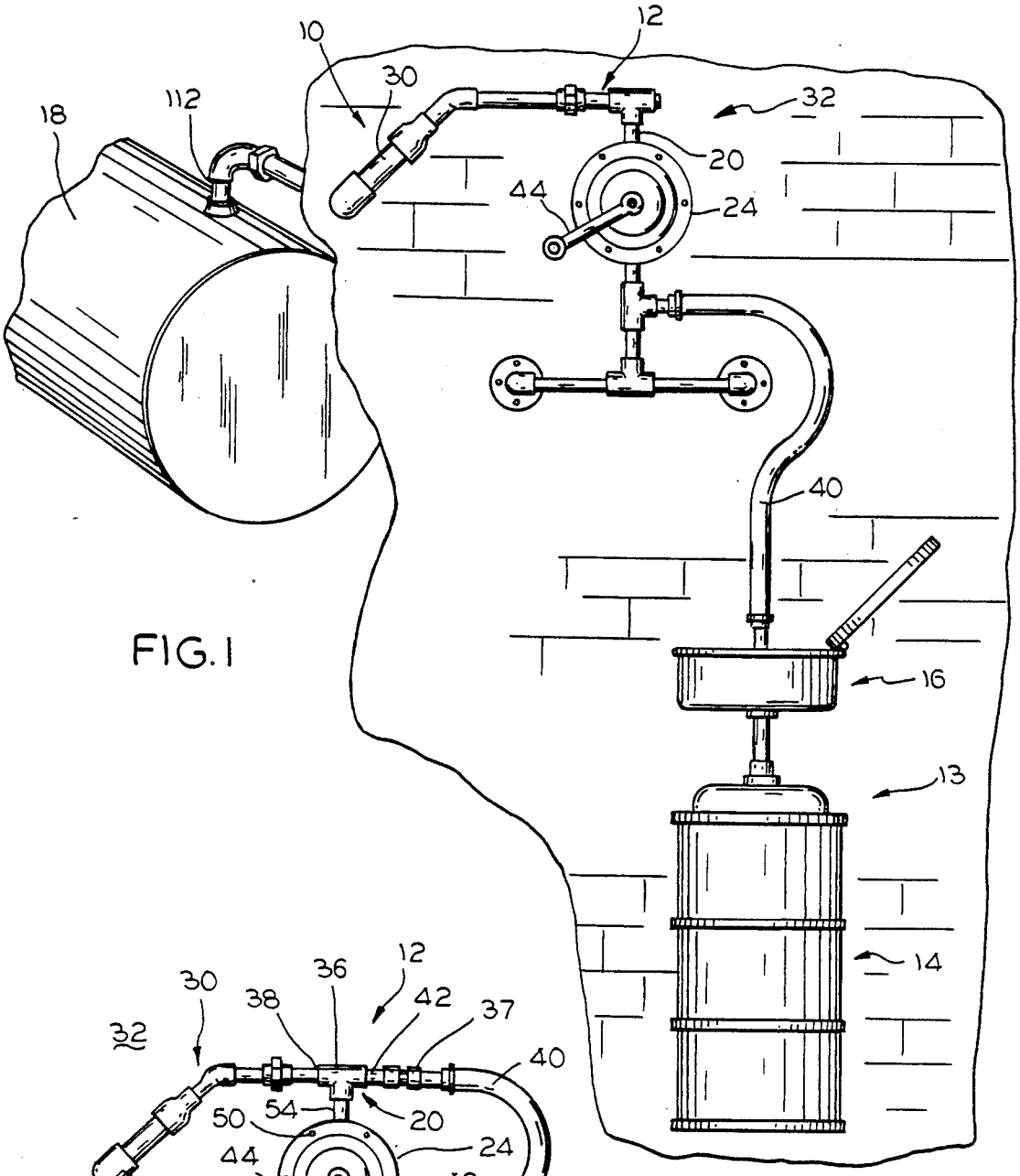
FIG. 1 is a perspective view of the inventive apparatus, illustrating the relationship between the holding tank, pump and funnel assemblies and drum.

Referring first to FIG. 1, the invention provides a method and apparatus for evacuating and transferring liquid waste from one container to another, with the apparatus generally denoted by the numeral 10 having, in part, a pump assembly 12, a waste oil drain assembly comprising a drum or other container 14 and a funnel assembly 16, and a holding tank 18. Generally, fluid is collected from automobiles and other sources by draining the fluid into funnel assembly 16 and storing the fluid in drum 14. The stored fluid in drum 14 is then transferred by a preferably wall-mounted pump assembly 12 into holding tank 18. The drum 14 is not dismantled during the fluid transferring process, and the operator of the assembly does not contact the fluid. The holding tank 18 is normally situated on the exterior of the building housing the pump assembly 12 and drum 14 for environmental and safety reasons.

Figure 2:
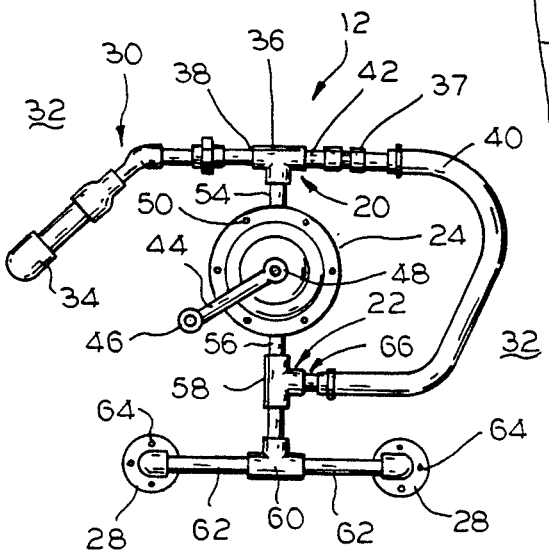
FIG. 2 is an elevation view of one embodiment of the inventive pump assembly of FIG. 1.
Figure 3:
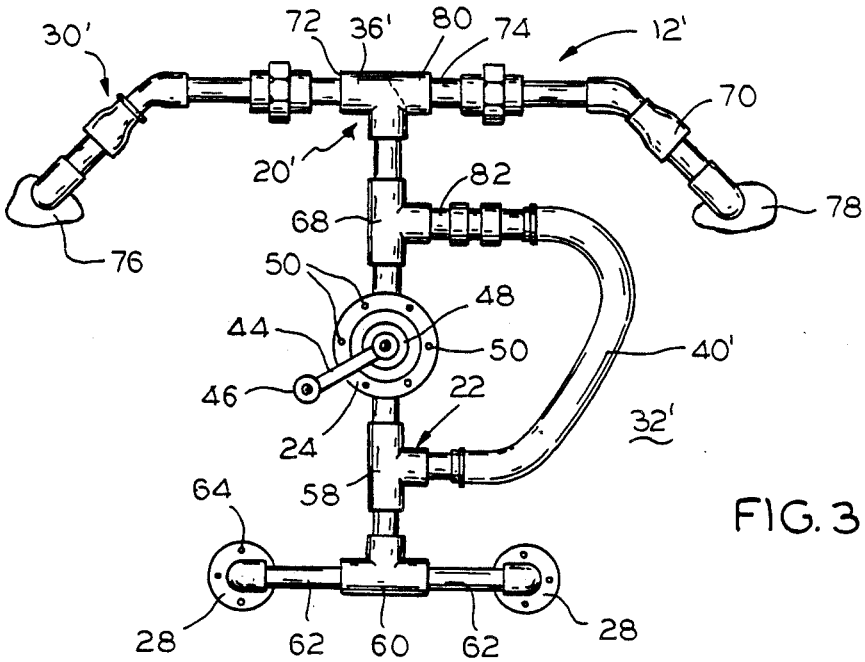
FIG. 3 is a plan view of another embodiment of the inventive pump assembly of FIG. 2.
Figure 4:
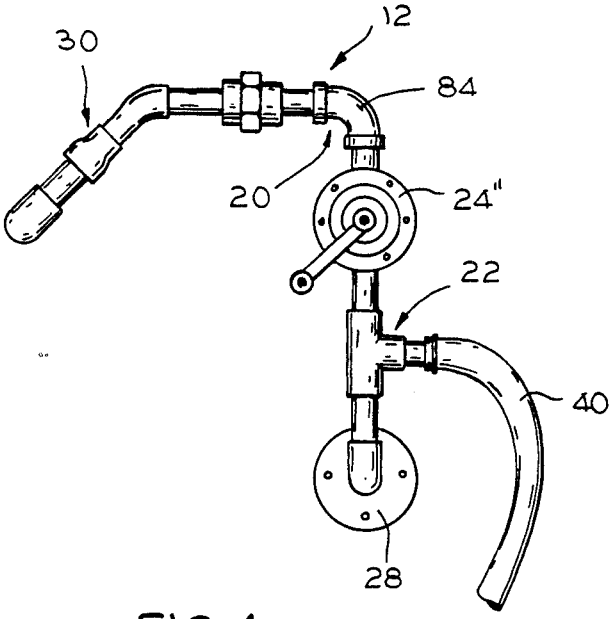
FIG. 4 is a plan view of another embodiment of the inventive pump assembly of FIG. 2.
Figure 5:
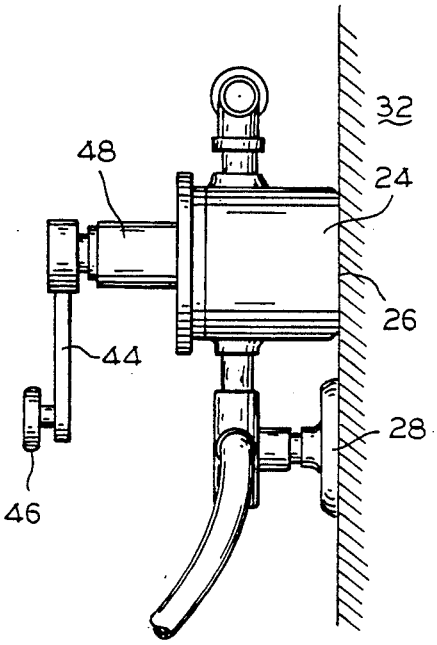
FIG. 5 is a fragmentary side perspective view of the inventive pump assembly of FIG. 2.

FIGS. 2–5 show various embodiments of the pump assembly 12, each of which will be described in more detail. In each embodiment, the pump 12 is mounted on the wall of a garage or other structure. FIGS. 2–4 show the pump assembly 12 having, in part, an output side 20, an intake side 22 and a pump mechanism 24. The pump assembly 12 in each of FIGS. 2–4 is mounted to the wall by a first mounting mechanism 26 that is located directly behind the pump 24, (see FIG. 5), and also by second mounting plates 28 that are disposed beneath the pump (see FIGS. 2–5).

FIG. 2 shows one embodiment of pump assembly 12. Referring first to the output side 20 of pump assembly !2, the apparatus comprises an elbow pipe assembly 30 which at one end extends through the wall 32 through sealed aperture 34 and is attached to a holding tank 18 which is located on the other side of the wall 32 and which will be discussed in greater detail later. Elbow pipe 30 at the end adjacent tank 18 is approximately two inches in diameter. Pipe 30 is positioned or bent at a 45 degree angle between aperture 34 and first T-joint 36, and is attached to wall 32 at aperture 34 such that pipe 30 is elevated above holding tank 18.

Elbow pipe 30 is connected to first T-joint 36 at point 38 on the output side 20 of pump assembly 12. The opposite side of T-joint 36 may be capped or otherwise closed off, and includes a fitting 37 which serves to hold the free end of flexible hose 40 when the hose is not in use. Hose 40 is removably attached to first T-joint 36 at point 42. Accordingly, that portion of first T-joint 36, as indicated at point 42, which retains flexible hose 40 when it is inoperative, is filled with concrete or any other solid material to block fluid flow from first T-joint 36 into flexible hose 40. Below first T-joint 36 is pump mechanism 24 which is mounted to the wall at point 26 (see FIG. 5). Pump mechanism 24 includes a manually operable handle 44 with knob 46. Handle 44 is fixed to drive shaft 48 (see FIG. 5) to rotate the pump drive shaft. In another embodiment, drive shaft 48 may be driven by any conventional motor and transmission means.

The output portion 20 is connected to pump mechanism 24 by a segment of piping 54. Piping 54 is situated between and attached to pump mechanism 24 and first T-joint 36. The intake of pump mechanism 24 is attached to intake side 22 by a segment of piping 56. Piping 56 is situated between and attached to pump mechanism 24 and a second T-joint 58.

Second T-joint 58 thus is attached to pump mechanism 24 via piping 56 at one end and on the opposite end is attached to a third T-joint 60. Second T-joint 58 further includes a connector piece 66 that connects flexible hose 40 to pump assembly 12.

Third T-joint 60 includes lateral pipes 62 extending from each of its opposite ends. Each pipe 62 is secured to wall 32 by mounting flanges 28. Mounting flanges 28 are bolted into wall 32 by bolts 64. The internal portion of T-joint 58 is capped with concrete or any other suitable material to block flow between pipes 62 and the input channel leading to pump mechanism 24. Therefore, hose 40 provides the only input fluid conduit leading to pump mechanism 24.

FIGS. 3 and 4 illustrate alternate embodiments of pump assembly 12. FIG. 3 shows a pump assembly that has the same intake side structure 22 as the assembly of FIG. 2, but has a different output side 20'. In the embodiment of FIG. 3, pump assembly 12' includes a first T-joint 36' that is connected to both a first elbow pipe 30' and a second elbow pipe 70 which are attached to first T-joint 36' at points 72 and 74, respectively. Both first elbow pipe 30' and second elbow pipe 70 extend through wall 32' at points 76 and 78, respectively, and are each attached to different holding tanks which are located on the other side of wall 32'. A manually controlled shut-off valve 80 is located inside of first T-joint 36', and operates to allow fluid to flow only out of first elbow pipe 30' in one of its positions and then allows fluid flow out of second elbow pipe 70 in another of its positions. If desired, other T-joints may be added, along with other shut-off valves, so that a plurality of holding tanks are attached to the pump assembly. Thus, there is no limit on the number of holding tanks that may be attached to the pump assembly described herein.

A second T-joint 68 is attached to first T-joint 36' on the output side 20' of the pump assembly in FIG. 3. Second T-joint 68 is positioned between first T-joint 36' and pump mechanism 24'. Flexible hose 40' is attached to second T-joint 68 at fitting 82.

FIG. 4 shows a further embodiment of pump assembly 12 in which the elbow pipe 30" is connected to pump 24" by a J-shaped joint 84 instead of a T-joint, as shown in FIGS. 2 and 3.

Figure 6:
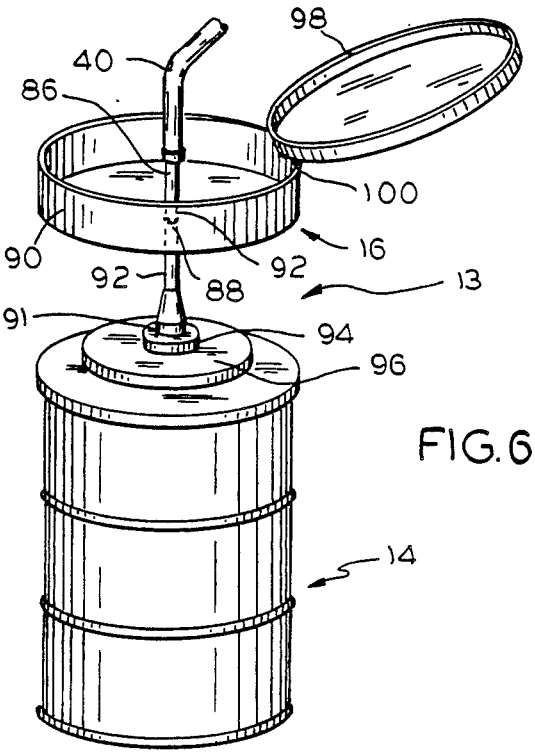
FIG. 6 is a perspective view of the funnel assembly and drum of FIG. 6.

Referring next to FIGS. 1 and 6, flexible hose 40 is attached to the funnel assembly 16 of waste oil drain assembly 13, which includes inter alia, drum or container 14 as well as funnel assembly 16. Funnel assembly 16 includes a quick connect 86 attached to drain pipe 92 which extends through funnel opening 88 and into drum 14. Drain pipe 92 also supports a funnel 90. Drain pipe 92 includes an outwardly and downwardly sloping but broadened base 94 at the point at which it intersects and is attached to drum lid 96. Drum lid 96 is secured to drum 14 along its perimeter.

Figure 7:
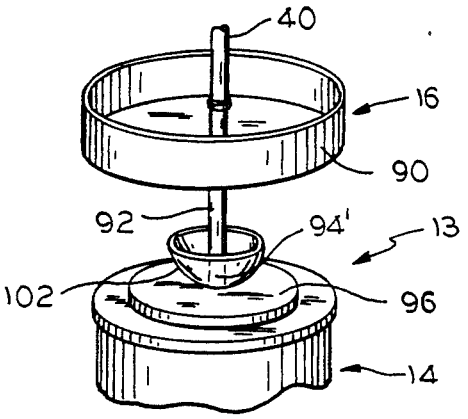
FIG. 7 is a fragmentary perspective cut-away view of the lid of the drum of FIG. 7.

In an alternate embodiment, as shown in FIG. 7, the drain pipe 92 can have a base 94' that is only slightly larger than the diameter of pipe 92. Extending from base 94' is a bowl-like container 102 which extends outwardly and upwardly and serves to hold tools and other equipment. Container 102 may include a plurality of holes in the base thereof to drain any liquid waste from the tools into the drum 24.

Funnel 90 (FIG. 6) is cylindrical in shape and has a depth of approximately 6 to 8 inches. A funnel lid 98 is swively mounted on the lip of funnel 90 by a rotatable clasp 100. When the funnel 90 is not in use, the lid 98 may be rotated over the funnel 90 to cover same. Funnel 90 may be raised or lowered with drain pipe 92 according to need by adjusting a set screw 91 that is attached to base 94.

Figure 8:
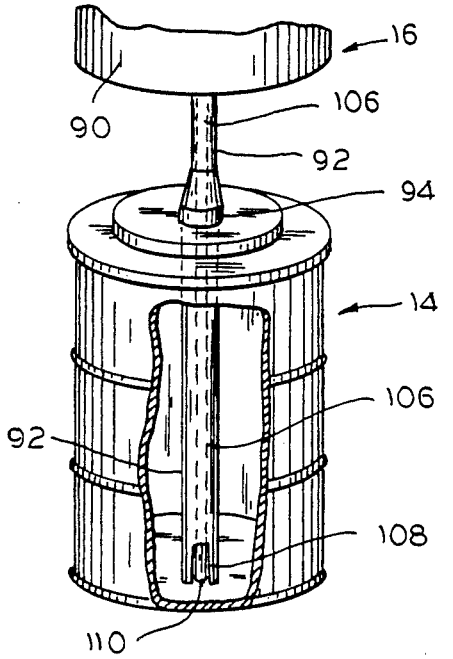
FIG. 8 is a perspective view of the interior of the inventive drum of Fig. 1, illustrating the drain and suction pipes.
Figure 9:
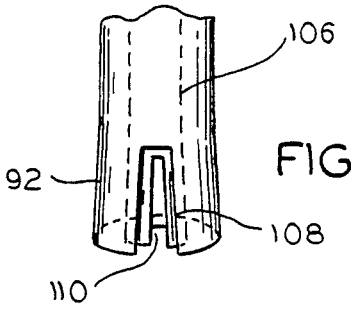
FIG. 9 is a fragmentary perspective view of the bottom of the drum and suction pipes, as shown in FIG. 8.

Referring to FIGS. 6, 8 and 9, drain pipe 92 (FIG. 8) is attached to the underside of base 94 on the interior of drum 14, and extends down the center of drum 14 to the bottom thereof. A suction pipe 106 extends from the base of the funnel 90, down the center of the drain pipe 92 and terminates at the bottom of drum 14 with drain pipe 92. Suction pipe 106 is circumferentially parallel to drain pipe 92, but has a smaller diameter than drain pipe 92. Drain pipe 92 and suction pipe 106 each include at least one slit 108 and 110, respectively, present on the end of each pipe that contacts the bottom of drum 14 which prevents air buildup in the piping system. Slits 108 and 110 extend upwardly from the base of drain pipe 92 and suction pipe 106 for a distance of approximately four inches.

Figure 10:
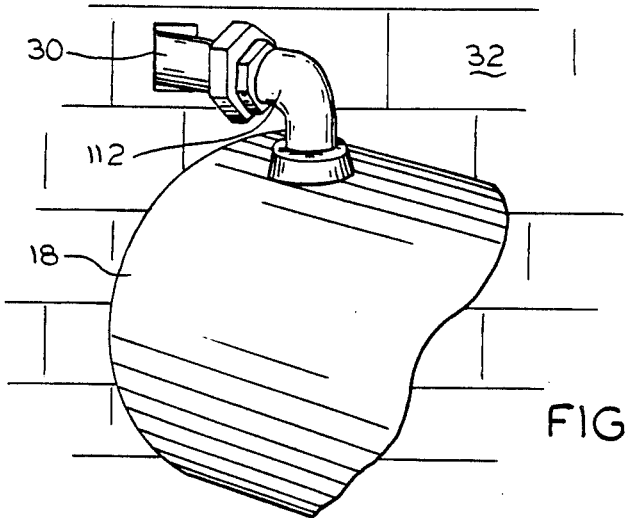
FIG. 10 is a fragmentary perspective view of the holding tank of FIG. 1 and the intake pipe for the tank.

Holding tank 18 is shown in FIGS. 1 and 10. Holding tank 18 receives the fluid transferred by pump assembly 12 from container 14, as will be described. As previously mentioned, holding tank 18 is attached to pump assembly 12 via an elbow pipe that extends through the wall 32 and is connected to tank 18. Specifically, elbow pipe 3 extends into wall 32 and is connected to piping 112 that leads into holding tank 18. Piping 112 may be whatever length is necessary to connect elbow pipe 30 with the holding tank 18. Elbow pipe 30 is elevated above holding tank 18 so that gravity forces the fluid from elbow pipe 30 into holding tank 18.

The method for evacuating and transferring liquid waste from drum 14 to holding tank 18 involves using the aforementioned described apparatus as follows: First, funnel assembly 16 is used to fill drum 14 with liquid waste, such as automotive crankcase oil. Waste is typically removed from, for example, an automobile by positioning drum 14 beneath the crankcase drain port. The funnel 90 and pipe 92 may be raised or lowered to accommodate the height of the vehicle. The liquid from the vehicle is drained into the funnel 90. Funnel lid 98 is used to catch liquid that may miss funnel 90. Tools that are used in this process may be optionally placed in the bowl-like container 102, described in FIG. 7.

The fluid removed from the vehicle is captured by funnel 90, and then drains through funnel opening 88 and into suction pipe 106 which is inside of funnel support 92. Disconnect 86 is not attached to funnel 90 at this point. Should the drain plug fall into funnel 90, suction pipe 106 prevents the plug from falling into drum 14 as the diameter of pipe 106 is such that the plug is too large to fall through.

Eventually, drum 14 will become filled with liquid waste and require evacuation. Evacuation of liquid waste from drum 14 is accomplished by detaching hose 40 from fitting 37 of T-joint 36 and attaching the free end of flexible hose 40 of pump assembly 12 to quick connect 86 which is located directly above funnel opening 88 and which is installed over pipes 92 and 106 after drum 14 is full. The other end of flexible hose 40 is attached to pump assembly 12. Handle mechanism 44 of pump 24 is manually rotated by knob 46, or a conventional motor rotates pump drive shaft 48 causing the liquid waste in drum 14 to be sucked upward through the slit 110 in the bottom of suction pipe 106 in drum 14. The fluid travels on this upward path through suction pipe 106, out of funnel opening 88, into flexible hose 40, and into the intake side 22 of pump mechanism 24. The liquid exits pump mechanism 24 through the output side 20 and, in the embodiment of FIG. 2, through elbow pipe 30 and into holding tank 18. Since pump assembly 24 and elbow pipe 30 are elevated higher than holding tank 18, after the liquid passes through pump assembly 12 and beyond pump mechanism 24, the liquid is actually being pulled toward holding tank 18 by gravity. In the embodiment shown in FIG. 3, the liquid will pass through the pump assembly 12', exit out of pump mechanism 24' and enter either first elbow pipe 30 or second elbow pipe 70, depending on the position of shut-off valve 80 in first T-joint 36'. After drum 14 has been emptied, hose 40 is disconnected from quick connect 86, and its free end is remounted on fitting 37 (FIG. 2) or fitting 82 (FIG. 3) for storage.

The materials from which the main components of the pump assembly, drum, funnel assembly and holding tank are constructed include any conventional non-corrosive metal. The other components of the above-described apparatus may be made from materials such as flexible plastics or rubber.

Moreover, the above apparatus has not been described in terms of approximate measurements of the various components, as it should be understood that the size of the drum 14, funnel assembly 16, pump 24, and holding tank 18 may vary according to need. Thus, there may be a plurality of sizes of the above components. The sizes can vary, but are limited to the manufacturing equipment's capabilities.

Therefore, it should be recognized that, while the invention has been described in relation to a preferred embodiment thereof, those skilled in the art may develop a wide variation of structural details without departing from the principles of the invention. Therefore, the appended claims are to be construed to cover all equivalents falling within the true scope and spirit of the invention.

The invention claimed is:

1. An apparatus for evacuating and transferring liquid waste comprising a pump assembly that is connected to a holding tank and to a liquid container, said pump assembly being mounted on a wall and elevated above said holding tank, said pump assembly including a flexible hose detachably mounted on one end to said pump assembly and which is adapted to be connected at a second end to an aperture in said container, said aperture in said container being connected to suction means which includes a drain pipe and a suction pipe which extend to the bottom of said container to permit said pump assembly to drain substantially all of said liquid waste from said liquid container and into said holding tank, said drain pipe and suction pipe each including inhibiting means at the bottom thereof to prevent air build up therein.

2. The apparatus of claim 1 wherein said pump assembly operates manually.

3. The apparatus of claim 1 wherein said pump assembly is driven by motor means attached to a drive shaft of said pump assembly.

4. The apparatus of claim 1 wherein said inhibiting means comprises slit means disposed in the bottom of said drain pipe and said suction pipe.

5. The apparatus of claim 1 wherein said pump assembly is elevated above said holding tank so that said liquid waste is partially transferred into said holding tank by gravity.

6. The apparatus of claim 1 wherein said pump assembly is connected to a plurality of holding tanks.

7. The apparatus of claim 6 wherein said pump assembly includes valve means to selectively direct fluid from said pump assembly to one of said holding tanks while preventing fluid flow between said pump assembly and any of the remaining holding tanks.

8. An apparatus for evacuating and transferring liquid waste comprising a pump assembly that is connected to a holding tank and to a fluid container, said pump assembly adapted to remove said liquid waste from said container and transferring said liquid waste to said holding tank, said pump assembly being mounted on a wall and being elevated above said holding tank so that said liquid waste is partially transferred into said holding tank by gravity, said pump assembly including a flexible hose that extends from said assembly and is attached to said container, said container including a drain pipe and a suction pipe therein, said drain pipe and said suction pipe including at least one slit in the bottom thereof to inhibit air build-up therein.

9. The apparatus of claim 8 wherein said pump assembly is connected to a plurality of holding tanks.

10. The apparatus of claim 8 wherein said waste liquid container includes retaining means attached to a lid covering said container, said retaining means extending outwardly and upwardly and being adapted to hold tools and other automotive equipment and parts.

11. An apparatus for evacuating and transferring liquid waste comprising a pump assembly that is connected between a holding tank and a liquid waste container for transferring said liquid waste from said container to said holding tank, said pump assembly including: pump mechanism means having an intake means and an output means, said output means connected to said holding tank at a point above said holding tank to provide a gravity assist to the fluid being transferred to said holding tank, pump intake means including flexible hosing means adapted to be removably attached to said liquid waste container; said liquid waste container including pipe means therein extending to the bottom of said container, said pipe means including a drain pipe and a suction pipe having inhibiting means at the lower end thereof to prevent air from being drawn into said drain pipe and said suction pipe when said pump assembly is operative.

12. The apparatus of claim 11 wherein said pump assembly includes a fitting adapted to removably mount one end of said flexible hosing when said pump assembly is not operative.

13. The apparatus of claim 11 wherein said inhibiting means includes slit means at the bottom of said suction pipe means.

14. The apparatus of claim 11 wherein said holding tank is disposed above ground level, and said pump assembly is mounted on the wall of a structure separating said waste liquid container from said holding tank at a position above the highest extent of said holding tank.

15. A method for evacuating and transferring liquid waste comprising a pump assembly mounted on a wall and connected to a holding tank and to a liquid waste container, comprising the steps of: evacuating said liquid waste from said container through a suction means which includes a drain pipe and a suction pipe and which are located in said container, pumping said liquid waste through said drain pipe and said suction pipe and a flexible hose attached to said pump assembly and said drain pipe and said suction pipe, said liquid waste passing through said flexible hose and into an intake side of said pump assembly and exiting from an output side of said pump assembly disposed above the level of said holding tank, said liquid waste being eventually discharged from said output side of said pump assembly into said holding tank partially by gravity and partially by the force of said pump assembly.

16. The method of claim 15 wherein said pump assembly is connected to a plurality of holding tanks.

17. The method of claim 16 wherein said pump assembly transmits said liquid waste to one of said holding tanks while preventing flow of said liquid waste between said pump assembly and said other holding tanks.

* * * * *